US005875796A

United States Patent [19]

Silver-Isenstadt et al.

[11] Patent Number: 5,875,796

[45] Date of Patent: Mar. 2, 1999

[54] APPARATUS FOR CLEANING TEETH

[76] Inventors: Ari D. Silver-Isenstadt; Jean L. Silver-Isenstadt, both of 9038 Queen Maria Ct., Columbia, Md. 21045

[21] Appl. No.: 947,628

[22] Filed: Oct. 9, 1997

[51] Int. Cl.[6] ..... A46B 11/00; A46B 9/04; A45D 40/00

[52] U.S. Cl. ..... 132/311; 132/312; 15/167.1

[58] Field of Search ..... 132/311, 312, 132/84 R; 15/167.1, 105

[56] References Cited

U.S. PATENT DOCUMENTS

| | | | |
|---|---|---|---|
| 2,486,062 | 10/1949 | Ridner, Sr. | 15/167 |
| 2,877,477 | 3/1959 | Levin | 15/105 |
| 3,890,986 | 6/1975 | Gerlich | 132/84 A |
| 4,140,140 | 2/1979 | Proia et al. | 132/84 B |
| 4,152,804 | 5/1979 | Morris | 15/167 R |
| 4,209,871 | 7/1980 | Ernest et al. | 15/167 R |
| 4,341,230 | 7/1982 | Siahou | 132/84 B |
| 4,744,124 | 5/1988 | Wang et al. | 15/105 |
| 4,821,752 | 4/1989 | Widlak | 132/309 |
| 5,305,490 | 4/1994 | Lundgren | 15/167.1 |
| 5,339,479 | 8/1994 | Lyman | 15/105 |
| 5,361,446 | 11/1994 | Rufo | 15/167.1 |

*Primary Examiner*—John J. Wilson
*Assistant Examiner*—Trang Doan
*Attorney, Agent, or Firm*—Roylance, Abrams, Berdo & Goodman, L.L.P.

[57] ABSTRACT

An apparatus for cleaning teeth having a first portion with a teeth cleaning element such as a brush. The apparatus further having a second portion coupled to the first portion and having a wall with an inner surface defining a cavity, an outer surface, and an aperture extending completely through the wall providing a passageway between the cavity and the inner surface. A roll of messaging sheets being positioned within the cavity and the aperture being sufficiently large to allow a sheet section to pass therethrough. The sheet section preferably having an adhesive sticker removably attached thereto.

20 Claims, 2 Drawing Sheets

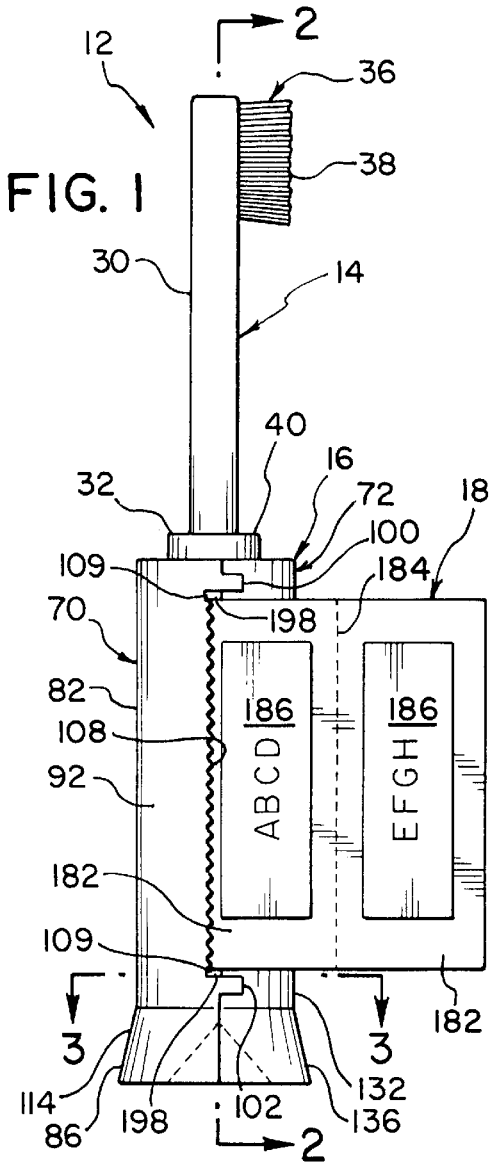
FIG. 1
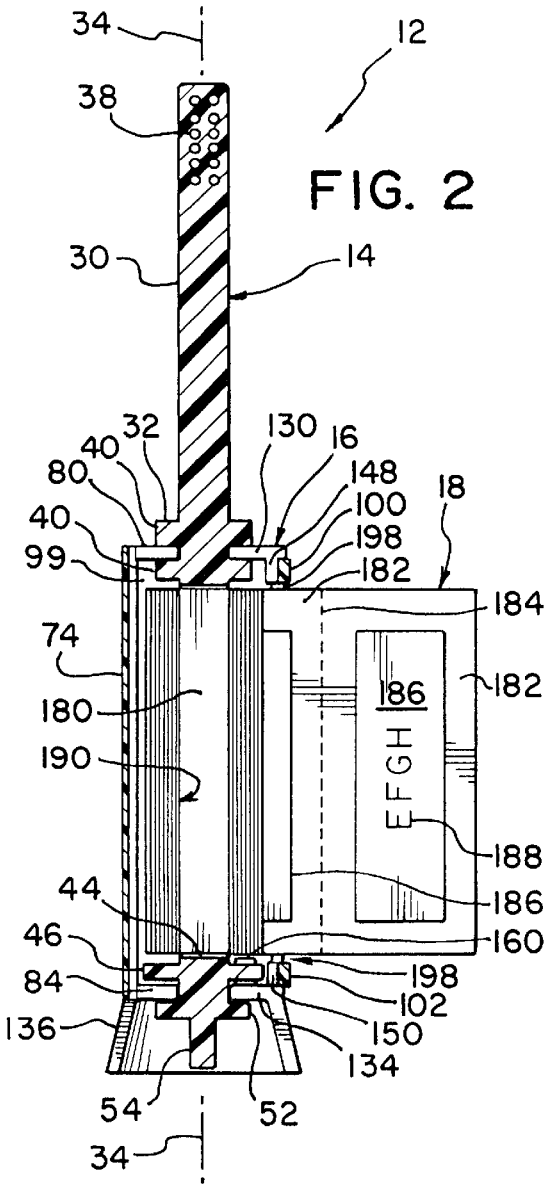
FIG. 2
FIG. 3
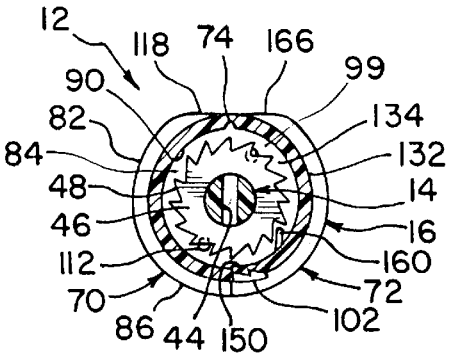
FIG. 4
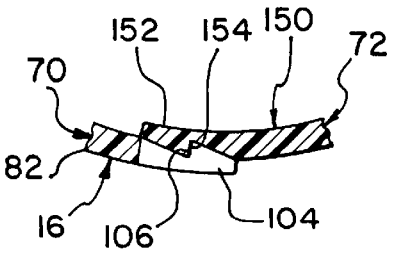

ABCD
EFGH
IJKL

APPARATUS FOR CLEANING TEETH

FIELD OF THE INVENTION

The present invention relates to an apparatus for cleaning teeth that also dispenses items. More specifically, the present invention relates to a toothbrush that dispenses a plurality of individual sheet sections which have adhesive stickers removably attached thereto.

BACKGROUND OF THE INVENTION

The brushing of children's teeth has been an age old problem for parents. Most children are not easily persuaded to brush their teeth regularly. Some prior art toothbrushes have attempted to remedy this problem by providing entertainment for children while they brush their teeth. This has been attempted in various ways but has not solved the problem of getting children to regularly brush their teeth.

Examples of some prior toothbrushes that attempt to produce sounds and/or lights are disclosed in U.S. Pat. Nos. 2,877,477 to Levin; 4,341,230 to Siahou; 4,744,124 to Wang et al. and 5,339,479 to Lyman.

Examples of additional prior toothbrushes are disclosed in U.S. Pat. Nos. 2,486,062 to Ridner; 3,890,986 to Gerlich; 4,140,140 to Proia et al.; 4,152,804 to Morris; 4,209,871 to Ernest et al.; 4,821,752 to Widlak; 5,305,490 to Lundgren and 5,361,446 to Rufo.

Thus, there is a continuing need to provide improved toothbrushes that encourage children to regularly brush their teeth. This invention addresses this need in the art as well as other needs which will become apparent to those skilled in the art once given this disclosure.

SUMMARY OF THE INVENTION

One object of the present invention is to provide an apparatus for cleaning teeth that dispenses items.

Another object of the invention is to provide an apparatus for cleaning teeth that encourages individuals to brush their teeth by rewarding the individual.

Still another object of the invention is to provide a toothbrush that automatically indicates that it must be replaced.

Yet another object of the invention is to provide a toothbrush that dispenses messaging sheets.

A further object of the invention is to provide a toothbrush that dispenses a plurality of adhesive stickers.

The foregoing objects are basically attained by providing an apparatus for cleaning teeth comprising a first portion having a teeth cleaning element; a second portion coupled to the first portion and having a wall with an inner surface defining a cavity, an outer surface, and an aperture extending completely through the wall providing a passageway between the cavity and the inner surface; and a sheet positioned within the cavity, the aperture being sufficiently large to allow the sheet to pass therethrough.

The foregoing objects are also attained by providing an apparatus for cleaning teeth comprising a first portion having a teeth cleaning element; a second portion coupled to the first portion; and a plurality of members removably coupled to the second portion, each of the plurality of members having indicia thereon and being further removably coupled to each other.

Other objects, advantages, and salient features of the invention will become apparent from the following detailed description, which, taken in conjunction with the annexed drawings, discloses preferred embodiments of the invention.

BRIEF DESCRIPTION OF THE DRAWINGS

Referring now to the attached drawings, which form a part of this original disclosure:

FIG. 1 is a side elevational view of a toothbrush in accordance with the present invention;

FIG. 2 is a cross-sectional view taken along line 2—2 of FIG. 1, illustrating the toothbrush in accordance with the present invention;

FIG. 3 is a cross-sectional view taken along line 3—3 of FIG. 1, illustrating the toothbrush in accordance with the present invention;

FIG. 4 is a partial, enlarged cross-sectional view of the locking tabs in accordance with the present invention and as illustrated in FIG. 3;

DETAILED DESCRIPTION OF PREFERRED EMBODIMENTS

Figures 5, 6, 7, 8:
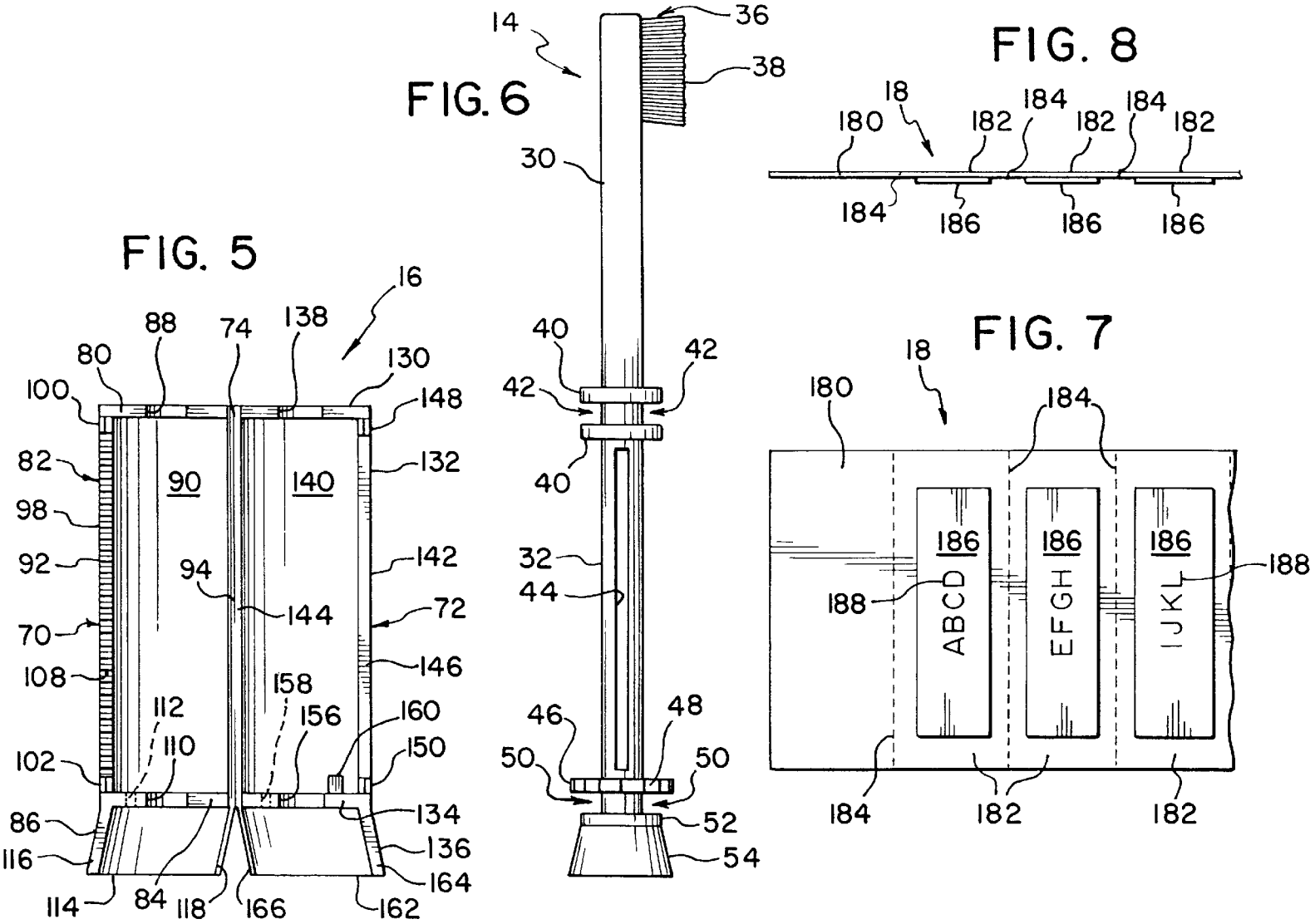
FIG. 5 is a side elevational view of the dispensing handle of the toothbrush in accordance with the present invention in the open position.
FIG. 6 is a side elevational view of the stem of the toothbrush in accordance with the present invention.
FIG. 7 is a side elevational view of the messaging sheets in accordance with the present invention with adhesive stickers thereon.
FIG. 8 is a top view of the messaging sheets illustrated in FIG. 7 and in accordance with the present invention.

As seen in FIGS. 1–7, a toothbrush 12 is illustrated in accordance with the present invention. The toothbrush has a stem 14, a dispensing handle 16, and messaging sheets 18. Toothbrush 12 is configured such that messaging sheets 18 are unwound out of dispensing handle 16 to provide a reward for the user of the toothbrush after brushing their teeth. Accordingly, users are encouraged to brush regularly. Additionally, messaging sheets are configured to run out after three months of brushing twice a day in order to entice the user to regularly obtain a new toothbrush, as recommended by dentists.

As best seen in FIGS. 2 and 6, stem 14 has a head 30, and a coupling portion 32 that each extend along a stem longitudinal axis 34. Head 30 preferably has a brush 36 formed of bristles 38 in a conventional manner. Except for brush 36, stem 14 is preferably made of plastic material of the type that is typically used to make conventional toothbrushes. However, other materials may be used that are similarly appropriate for forming toothbrushes. All parts of stem 14 except for brush 36 are preferably integrally formed as a unitary, one-piece member.

Although head 30 is shown as extending substantially along longitudinal axis 34, it should be understood that head 30 and brush 36 can take any form known in the art. For instance, head 30 can be curved and brush 36 can be compacted to allow for easier access to certain teeth.

Coupling portion 32 receives dispensing handle 16 and messaging sheets 18 and provides a mechanism for dispensing messaging sheets 18 in a controlled, uniform manner as discussed below. Coupling portion 32 has circular upper flanges 40 adjacent head 30 which form upper groove 42 for receiving an upper portion of dispensing handle 16. Stem 14 is substantially circular in cross section between upper flanges 40.

Below upper flanges 40, coupling portion 32 has a longitudinal slot 44 that extends completely through stem 14 and is generally rectangular in side elevational view as seen in FIG. 6. Slot 44 is sized to receive messaging sheets 18 therethrough.

The bottom of coupling portion 32 has a ratchet wheel 46 positioned below slot 44. Ratchet wheel 46 has teeth 48 that interact with dispensing handle 16 to uniformly dispense messaging sheets 18 and to prohibit messaging sheets 18 from being wound upon each other within toothbrush 12.

Coupling portion 32 further has a lower groove 50 formed by ratchet wheel 46 and lower flange 52, and a key 54 extending from lower flange 52. Lower flange 52 is circular and similar to upper flanges 40. The portion of stem 14 between ratchet wheel 46 and lower flange 52 is substantially circular in cross section and substantially identical to the area of stem 14 between upper flanges 40. Also, lower groove 50 receives dispensing handle 16 in a manner substantially identical to upper groove 42. Lower groove 50 can have the same thickness as upper groove 42 or one of grooves 42 and 50 can have a greater thickness to provide greater room for receiving dispensing handle 16. It is only necessary that one of grooves 42 and 50 provide a tight fit with dispensing handle 16 to prohibit excessive movement of dispensing handle 16 along longitudinal axis 34.

Key 54 is accessible from the bottom of toothbrush 12 and provides a means for rotating stem 14 about longitudinal axis 34 to dispense messaging sheets 18. Key 54 is preferably substantially planar and substantially trapezoidal to allow easy gripping by the user.

As seen in FIGS. 1–4 and 6, dispensing handle 16 has a first half 70 and a second half 72 that are pivotally coupled to each other about hinge 74. First and second halves 70 and 72 can pivot about hinge 74 between an open position as illustrated in FIG. 5 to a closed position as illustrated in FIG. 3. Dispensing handle 16 is preferably integrally formed of unitary, one-piece construction. Preferably, dispensing handle 16 is formed of plastic material similar to that of stem 14. It should be understood that dispensing handle 16 can be made from any number of elements that can be combined to form a dispensing handle that functions in a similar manner. Dispensing handle 16 is configured to be sufficiently rigid to be firmly gripped within the palm of the hand of the user while the user brushes their teeth. Also, dispensing handle 16 can be configured in various shapes to facilitate its being gripped by the user.

First half 70 has a top 80, a side wall 82, a bottom 84 and a base 86. Top 80 is a half-circular plate that has a half-circle opening 88 extending completely therethrough for receiving a portion of stem 14 having a circular cross-section. Side wall 82 is curved to form a half of a cylinder. Side wall 82 has an inner surface 90, an outer surface 92, a hinged end 94 integrally coupled to hinge 74, and a locking end 98. Side wall 82 extends from top 80 to bottom 84 to form part of a cylindrical cavity 99, which, when dispensing handle 16 is in the closed position, fully receives stem 14 and messaging sheets 18.

The upper portion of locking end 98 adjacent top 80 has an upper locking tab 100 and the lower portion of locking end 98 adjacent bottom 84 has a lower locking tab 102. Locking tabs 100 and 102 are substantially identical and are configured to couple with mating locking tabs on second half 72. As illustrated most clearly in FIG. 4, each locking tab 100 and 102 has a head 104 and a recess 106 to form a snap-fit with mating, substantially identical locking tabs as is known in the art.

Locking end 98 further has a row of teeth 108 that extends from upper locking tab 100 to lower locking tab 102. The row of teeth 108 sit in a recess 109 formed in locking end 98 and facilitate the separation of individual messaging sheets 18 while they are dispensed from dispensing handle 16.

Bottom 84 is substantially identical to top 80. Thus, bottom 84 a planar half-circular plate, which has a half-circle opening 110 extending completely therethrough for receiving a portion of stem 14 having a circular cross-section. Additionally, bottom 84 has a drain hole 112. Drain hole 112 extending completely through bottom 84 and allows any water accumulated within cavity 99 to pass through bottom 84 and outside cavity 99.

Base 86 extends from bottom 84 and has a flared wall 114 having a mating end 116 and a relieved end 118. Flared wall 114 provides a stable support for maintaining stem 14 in an upright position while placed on a support. Relieved end 118 provides freedom of movement and allows flared wall 114 to be spaced from second half 72 in the open position and to maintain a generally frusto-conical shape when dispensing handle 16 is in the closed position.

Second half 72 is substantially identical to first half 70 in its basic shape and configuration except that it is generally the mirror image of first half 70. Second half has a top 130, a side wall 132, a bottom 134, and a base 136. Top 130 is substantially planar and is substantially identical to top 80 except that it is a mirror image of top 80. Top 130 has a half circle opening 138 that is aligned with half circle opening 88 in top 80 to receive stem 14.

Side wall 132 is substantially identical to side wall 82 except it is a mirror image of side wall 82. Side wall 132 has an inner surface 140, an outer surface 142, a hinged end 142 coupled to hinge 74, and a locking end 146. Side wall 132 together with top 130 and bottom 134 form the second half of cavity 99, which is completely formed when both halves are in the closed position.

Adjacent top 130, locking end 146 has an upper locking tab 148. Additionally, adjacent bottom 134, locking end 146 has a lower locking tab 150. Locking tabs 148 and 150 each have a head 152 and a recess 154. Locking tabs 148 and 150 have substantially identical, but opposite construction as locking tabs 100 and 102. Each head 152 is configured to mate with and be received within recess 106 of its respective locking tab 100 or 102 while each recess 154 is configured to mate with and receive the head 104 of its respective locking tab 100 and 102.

Side walls 82 and 132 are sufficiently resilient so that when first and second halves 70 and 72 are brought together to the closed position, locking tabs 100, 102, 148 and 150 will slightly flex to allow each set of locking tabs 100 and 148 and 102 and 150 to mate and lock halves 70 and 72 together as illustrated in FIGS. 3 and 4. Further, side wall 132 is sufficiently resilient so that the area of side walls 82 and 132 adjacent each locking tab 100, 102, 148 and 150 can be displaced slightly to allow the heads 104 and 152 to be released from their respective recesses 106 and 154. Thus, allowing halves 70 and 72 to be moved to the open position if desired.

Bottom 134 a circular plate that is similar to bottom 84. Bottom 134 has a half circle opening 156 that is substantially identical to, but the mirror image of half circle opening 110. Bottom 134 also has a drain hole 158 that extends completely therethrough and functions in a substantially identical manner as drain hole 112.

Bottom 134 further has a pawl 160 integrally attached thereto and to side wall 132 to interact with ratchet wheel 46 of stem 14 as is known in the art. Pawl 160 is configured to fit between each of the teeth 48 of ratchet wheel 46 to enable ratchet wheel 46 to rotate in only one direction incrementally. Pawl 160 is sufficiently resilient to bend when one of the teeth 48 is force over pawl 160 by the turning of key 54, while being sufficiently rigid to prohibit ratchet wheel from rotating in the opposite direction. The basic principles of ratchet wheel 46 and pawl 160 are well known.

Base 136 extends from bottom 134 and has a flared wall 162 having a mating end 164 and a relieved end 166. Flared wall 162 combines with flared wall 114 to form a widened base for adequately supporting toothbrush 12 in an upright position.

As best seen in FIGS. 7 and 8, messaging sheets 18 are preferably formed as a single sheet of material that can be separated into a number of smaller sheets. Messaging sheets 18 preferably have an attaching sheet 180 and a plurality of additional sheet sections 182. Attaching sheet 180 is attached to sheet sections 182 by a perforation 184. Additionally, each sheet section 182 is attached to other sheet sections 182 by similar perforations 184 as is known in the art.

Each sheet section 182 receives an adhesive sticker 186 thereon in a manner that is known in the art. Attaching sheet 180 and sheet sections 182 are preferably formed of a waxed paper or plastic material that can receive adhesive stickers 186 securely while enabling adhesive stickers 186 to be easily removed along with their respective adhesive from their respective sheet section 182. Such material is well known in the art. Adhesive stickers 186 are preferably conventional and well known gummed labels having any type of appropriate, releasable adhesive on one side which attaches sticker 186 to its respective sheet section 182 in a removable, replaceable fashion, and indicia 188 on the opposite side.

Adhesive stickers 186 can take any shape or form as is known in the art. For example, indicia 188 can take the form of drawings, printing, text, pictures, etc. Ideally, the indicia will serve an educational purpose. Adhesive stickers 186 can also be used in various shapes and used with or without indicia 188. For instance, they can be shaped and colored to resemble animals, objects, toys, automobiles, etc., as is known in the art. Further, adhesive stickers 186 can be colorful designs in various shapes, and a plurality of adhesive stickers 186 can be attached to a single sheet section 182 if desired. Adhesive stickers 186 can be constructed for individual use and then discarded, or be used with other devices or materials after being removed from toothbrush 12. For example, adhesive stickers 186 can be ultimately placed in a book for receiving adhesive stickers 186 in order to enhance the enjoyment of the adhesive stickers 186. The books for receiving adhesive stickers 186 can be educational or otherwise.

Alternatively, messaging sheets 18 can themselves contain the indicia or message or colorful design without the use of adhesive stickers 186. The user would tear off a sheet section 182, and the sheet section 182 would contain indicia 188 or designs directly thereon. This may be more appropriate for older children and adults.

In order to use toothbrush 12, messaging sheets 18 are first attached to stem 14. The manner of attaching messaging sheets 18 to stem 14 can occur in many ways. Preferably, messaging sheets 18 are attached to stem 14 by inserting attaching sheet 180 into slot 44. Once attaching sheet 180 is extending completely through slot 44, messaging sheets 18 are wound around stem 14 between upper flanges 40 and lower flange 52. When messaging sheets 18 are completely wound around stem 14, messaging sheets 18 form a substantially cylindrical roll or tube 190 having a longitudinal axis that is substantially collinear with longitudinal axis 34.

Dispensing handle 16 is then positioned around stem 14 and tube 190 of messaging sheets 18 and halves 70 and 72 are pivoted about hinge 74 from the open position illustrated in FIG. 5 to the closed position illustrated in FIGS. 1–3.

First and second halves 70 and 72 are pivoted about hinge 74 until locking ends 98 and 146 come together and upper and lower locking tabs 100 and 102 mate with upper and lower locking tabs 148 and 150. As locking tabs 100 and 102 of first half 70 meet locking tabs 148 and 150 of second half 72, heads 104 and 152 of each respective locking tab meet and resiliently bend their respective half 70 and 72 until each head 104 and 152 is received in the respective recess 106 and 154 of the opposite locking tab by a snap fit.

In the closed position, tops 80 and 130 of stem 14 are positioned within upper groove 42 of dispensing handle 16 and bottoms 84 and 34 of stem 14 are positioned within lower groove 50 of dispensing handle 16 as illustrated in FIG. 2. Also, dispensing handle 16 now completely forms cylindrical cavity 99 that receives stem 14 and tube 190 of messaging sheets 18. Further, passageway 198 is formed between locking end 98 of first half 70 and locking end 146 of second half 72 by recess 109 to allow messaging sheets 18 to pass from within dispensing handle 16 to outside dispensing handle 16 to be received by the user of toothbrush 12.

As a reward for brushing teeth, the user of the toothbrush rotates key 54 in its one direction of rotation. As key 54 is turned, stem 14 rotates about longitudinal axis 34 and, in turn, the tube 190 of messaging sheets 18 rotates about longitudinal axis 34. Ratchet wheel 46 and pawl 160 are arranged as is known in the art to prohibit the user from rotating tube 190 in a direction that would result in all messaging sheets 18 being located within dispensing handle 16 and inaccessible to the user. Thus, the user rotates key 54 in the appropriate direction and messaging sheets 18 are dispensed from dispensing handle 16 by forwarding a sheet section 118 through passageway 198 and away from stem 14 until perforation 184 is aligned with the row of teeth 108. Then, the user tears the sheet section 182 from its adjacent sheet section 182 along its respective perforation 184 with the help of the row of teeth 108 as is known in the art. The adhesive sticker 186 on the discharged sheet section 182 is removed from its sheet section either before or after the separation of the sheet section 182 from the messaging sheets 18 along its perforation 184.

The amount of which stem 14 rotates about longitudinal axis 34 when key 54 is rotated is determined by the user. If desired, the teeth 48 of the ratchet wheel 46 can be sized so that the movement of a single tooth past pawl 160 corresponds to the discharge of one sheet section 182. Since the movement of a tooth past pawl 160 results in a noise such as a click, the user will know that one click of ratchet wheel 46 and pawl 160 when turning key 54 will discharge one sheet section 182.

When the user brushes their teeth again, the process of turning key 54 and rotating ratchet wheel 46 is repeated and a new sheet section 182 is discharged from dispensing handle 16. The discharged sheet section 182 is then removed from the messaging sheets 18 by tearing along its respective perforation 184. Adhesive sticker 186 being removed at some point from the discharged sheet section 182.

Although any number of sheet sections 182 and adhesive stickers 186 can be employed, it is preferred that a 180 count of sheet sections 182 be positioned within dispensing handle 16 so that the invention also acts as a reminder to replace toothbrush 12. Since the bristles of any toothbrush deform and become less effective, dentists commonly recommend that the toothbrush be replaced every three months. Using a 180 count of sheet sections 182 will allow the user to brush twice a day for 90 days before the adhesive stickers 186 are all dispensed. The replacement of brush 36 can occur in the form of the replacement of the entire toothbrush 12 as a single unit or the replacement of only stem 14 along with a new tube 190 of messaging sheets 18.

While advantageous embodiments have been chosen to illustrate the invention, it will be understood by those skilled in the art from this disclosure that various changes and modifications can be made therein without departing from the scope of the invention as defined in the appended claims.

What is claimed is:

1. An apparatus for cleaning teeth comprising:

a first portion having a teeth cleaning element and being positioned on a longitudinal axis;

a second portion coupled to said first portion and having a wall with an inner surface defining a cavity, an outer surface, and an aperture extending completely through said wall providing a passageway between said cavity and said outer surface, said second portion being positioned on said longitudinal axis, said first portion and said second portions being positioned at different locations along said longitudinal axis and being adjacent each other along said longitudinal axis; and a plurality of sheet sections positioned within said cavity, said aperture being sufficiently large to allow all portions of each of said plurality of sheet sections to pass completely therethrough.

2. The apparatus according to claim 1, wherein said teeth cleaning element has bristles.

3. The apparatus according to claim 1, wherein each of said plurality of sheet sections has a member removably coupled thereto.

4. An apparatus for cleaning teeth comprising:

a first portion having a teeth cleaning element;

a second portion coupled to said first portion and having a wall with an inner surface defining a cavity, an outer surface, and an aperture extending completely through said wall providing a passageway between said cavity and said outer surface; and a sheet positioned within said cavity, said aperture being sufficiently large to allow said sheet to pass therethrough, and said sheet has a member removably coupled thereto, said member having indicia located thereon.

5. The apparatus according to claim 4, wherein said member is removably coupled to said sheet by adhesive.

6. The apparatus according to claim 1, wherein each of said plurality of sheet sections is separated from each other by a perforation.

7. The apparatus according to claim 6, wherein each of said plurality of sheet sections has a member removably coupled thereto.

8. An apparatus for cleaning teeth comprising:

a first portion having a teeth cleaning element;

a second portion coupled to said first portion and having a wall with an inner surface defining a cavity, an outer surface, and an aperture extending completely through said wall providing a passageway between said cavity and said outer surface; and a sheet positioned within said cavity, said aperture being sufficiently large to allow said sheet to pass therethrough, said sheet being comprised of a plurality of sheet sections, each of said plurality of sheet sections being separated from each other by a perforation, and each of said plurality of sheet sections having a member removably coupled thereto, each said member having indicia located thereon.

9. The apparatus according to claim 8, wherein each said member is removably coupled to one of said plurality of sheet sections by adhesive.

10. The apparatus according to claim 9, wherein said plurality of sheet sections are arranged to wrap around each other to form a tube of sheet sections within said cavity, said tube having a longitudinal axis and a first length along said longitudinal axis, and said aperture extending generally parallel to said longitudinal axis and having a second length that is larger than said first length.

11. An apparatus for cleaning teeth comprising:

a first portion having a teeth cleaning element and positioned on a longitudinal axis;

a second portion coupled to said first portion and positioned on said longitudinal axis, said first portion and said second portion being positioned at different locations along said longitudinal axis and being adjacent each other along said longitudinal axis; and a plurality of members removably coupled to said second portion, each of said plurality of members having indicia thereon and being further removably coupled to each other by a perforated area.

12. The apparatus according to claim 11, wherein said teeth cleaning element has bristles.

13. An apparatus for cleaning teeth comprising:

a first portion having a teeth cleaning element;

a second portion coupled to said first portion; and a plurality of members removably coupled to said second portion, each of said plurality of members having indicia thereon and being further removably coupled to each other, each of said plurality of members being removably coupled to one of a plurality of support elements.

14. The apparatus according to claim 13, wherein each of said plurality of support elements is a sheet section.

15. The apparatus according to claim 14, wherein each of said plurality of members is removably coupled to one of said plurality of sheet sections by adhesive.

16. The apparatus according to claim 15, wherein each of said plurality of sheet sections are separated from each other by a perforation.

17. The apparatus according to claim 16, wherein each of said plurality of sheet sections is arranged to wrap around each other to form a tube of sheet sections, said tube having a first longitudinal axis, and said second portion having a second longitudinal axis that is collinear with said first longitudinal axis.

18. The apparatus according to claim 17, wherein each of said plurality of sheet sections is substantially rectangular and substantially planar.

19. The apparatus according to claim 14, wherein each of said plurality of sheet sections is arranged to wrap around each other to form a tube of sheet sections, said tube having a first longitudinal axis, and said second portion having a second longitudinal axis that is collinear with said first longitudinal axis.

20. The apparatus according to claim 19, wherein each of said plurality of sheet sections is substantially rectangular and substantially planar.

* * * * *